US009556695B2

(12) United States Patent
Jordy

(10) Patent No.: US 9,556,695 B2
(45) Date of Patent: Jan. 31, 2017

(54) MECHANICALLY LOCKED DEBRIS BARRIER

(71) Applicant: Baker Hughes Incorporated, Houston, TX (US)

(72) Inventor: Dustin R. Jordy, Thibodaux, LA (US)

(73) Assignee: Baker Hughes Incorporated, Houston, TX (US)

( * ) Notice: Subject to any disclaimer, the term of this patent is extended or adjusted under 35 U.S.C. 154(b) by 569 days.

(21) Appl. No.: 13/870,552

(22) Filed: Apr. 25, 2013

(65) Prior Publication Data

US 2014/0318765 A1 Oct. 30, 2014

(51) Int. Cl.
*E21B 33/12* (2006.01)
*E21B 27/00* (2006.01)
*E21B 43/10* (2006.01)

(52) U.S. Cl.
CPC ..... *E21B 27/00* (2013.01); *E21B 43/10* (2013.01)

(58) Field of Classification Search
CPC combination set(s) only.
See application file for complete search history.

(56) References Cited

U.S. PATENT DOCUMENTS 1,485,621 A * 3/1924 Loeffler ..... F16D 1/0817 403/352
2,698,056 A * 12/1954 Marshall ..... E21B 23/02 166/123
2,812,200 A * 11/1957 Yeargan ..... B08B 9/0436 166/173
3,083,041 A * 3/1963 Stanley ..... A47L 9/244 285/302
3,136,366 A * 6/1964 Brown ..... E21B 17/046 166/114
3,912,009 A * 10/1975 Davis, Jr. ..... E21B 23/02 166/240
4,266,578 A * 5/1981 Swain ..... E21B 17/105 138/110
4,406,324 A * 9/1983 Baugh ..... E21B 23/02 166/125
4,484,785 A 11/1984 Jackson
5,528,366 A 6/1996 Shortt
6,003,607 A * 12/1999 Hagen ..... E21B 17/07 166/120
6,408,945 B1 6/2002 Telfer
2004/0238185 A1 12/2004 Rothers et al.
2011/0108266 A1 5/2011 Smith et al.
(Continued)

*Primary Examiner* — David Andrews
*Assistant Examiner* — Ronald Runyan
(74) *Attorney, Agent, or Firm* — Steve Rosenblatt

(57) ABSTRACT

A debris barrier is installed and locked to the liner tieback extension. When it is time to check release from the liner before initiating a cement job the inner running string is lifted. The lock stays engaged to the liner tieback extension tube as the inner running string is lifted. In that manner the debris barrier remains in position during the lifting to determine release from the liner before cementing. After cementing, the inner running string is lifted further to eventually undermine the lock and capture the debris barrier to bring the debris barrier to the surface with the inner running string. The lock can be dogs or collets or the like. An inner sleeve or a lift sub with an upset can be the support whose axial movement beyond a predetermined value undermines the lock to release the debris barrier.

23 Claims, 9 Drawing Sheets

(56) References Cited

U.S. PATENT DOCUMENTS

| | | | | |
|---|---|---|---|---|
| 2012/0181048 | A1 | 7/2012 | Reinhardt et al. | |
| 2012/0298380 | A1* | 11/2012 | Rogers | E21B 33/12 166/387 |
| 2013/0032330 | A1 | 2/2013 | Heckel et al. | |

* cited by examiner

MECHANICALLY LOCKED DEBRIS BARRIER

FIELD OF THE INVENTION

The field of the invention is debris barriers that prevent entry of debris into an annular gap between relatively movable concentric tubulars.

BACKGROUND OF THE INVENTION

There are many occasions where an annular space between relatively moving tubulars can fill up with debris. In one case before cementing a liner that has been hung off an existing tubular through an inner running string, the inner running string is picked up far enough to determine that it is no longer secured to the liner so that after the cement job is done there are assurances that the inner running string will free to remove to the surface. Typically the inner running string is lifted a meter or more. During this lifting event debris that is in the vicinity can fall into the annular space between the liner and the running string. To combat this problem in the past debris barriers have been proposed which are basically annular shapes around the inner running string. Early efforts simply fixed the annular shape to the inner running string but this proved ineffective since on lifting the inner running string to make sure that there was release from the liner resulted in lifting the debris barrier too high and out of the liner tieback extension so that debris could still get into the annular gap between the running tools and the liner. Once debris gets into that gap there is a great chance that it may cause the inner running string to remain engaged to the liner via frictional forces or hydraulic locking the inner running string to the liner. If that happened a significant loss of time and cost in clearing the inner running string from the liner ensued and in some instances the inner running string could not be retrieved and sidetracking was then required.

From that point the focus shifted to ways to make the barrier effective downhole despite the significant amount of relative movement that takes place when confirming that the inner running string has released from the liner. In US Publication 2011/0108266 the debris barrier 7 is allowed to "float" on fluid introduced to an annular chamber below before the device is run in the hole. The problem with this design is that the debris can adhere the debris barrier to the lift mandrel that it surrounds with the unintended result of lifting the floating debris barrier away from its pool of fluid that was supposed to keep the barrier essentially stationary as the mandrel is lifted.

Other approaches touted the "hydraulic lock" where an elaborate system of seals to retain a volume of hydraulic fluid was used in an effort to keep the debris barrier in place. Such designs are illustrated in U.S. Pat. No. 6,408,945 (items 152 or 252) or U.S. Pat. No. 5,528,366 which is along the same line by the same inventor. The problems with this design are cost and reliability. The debris barrier had to have an internal reservoir that was initially filled at the surface and then used a network of seals to seal against the liner tieback extension so as to be able to maintain the liquid lock when the lift mandrel was lifted. Getting all these seals to effectively seal was key to the operation of the lock. However, there is the local debris issue and getting the seals to fit closely to the liner tieback extension that all could contribute to the loss of locking force. Finally the debris could wedge the barrier to the lift nipple to then put stress on the seals to hold the ever rising pressure if tandem movement occurred which could blow out a seal before surface personnel had any clue that such failure had occurred. In touting the hydraulic lock these references eschewed mechanical locking as undesirable and impractical in this application.

The present invention is a mechanical lock for the debris barrier. The barrier is locked when run in and remains locked as the lift nipple is raised. After a predetermined lifting the lock is defeated to allow the inner running string to be removed while capturing the debris barrier. Preferred designs of dogs and collets are disclosed. Those skilled in the art will gain a better understanding of these and other aspects of the invention from a review of the description of the preferred embodiment and associated drawings while recognizing that the full scope of the invention is to be determined by the appended claims.

SUMMARY OF THE INVENTION

A debris barrier is installed and locked to the liner tieback extension. When it is time to check release from the liner before initiating a cement job the inner running string is lifted. The lock stays engaged to the liner tieback extension tube as the inner running string is lifted. In that manner the debris barrier remains in position during the lifting to determine release from the liner before cementing. After cementing, the inner running string is lifted further to eventually undermine the lock and capture the debris barrier to bring the debris barrier to the surface with the inner running string. The lock can be dogs or collets or the like. An inner sleeve can be the support whose axial movement beyond a predetermined value undermines the lock to release the debris barrier. The inner sleeve can be one or more pieces and made of a composite or metallic material.

DETAILED DESCRIPTION OF THE PREFERRED EMBODIMENT

Those skilled in the art are familiar with a typical hookup to drill and place a liner in a wellbore and hang the liner to an existing tubular with an anchor and thereafter cement and set a liner seal. The liner typically has a tieback extension tubular 10 at the top and the inner running string extends into the liner to support the liner as well as to actuate the hanger and to facilitate cementing and setting the liner seal. Near the top of this inner running string that delivers the liner is a lift sub 12 that is connected to a string extending from the surface that is not shown. The focus is to show the equipment adjacent to the location where entry of debris can prevent release of the lift sub and all the bottom hole assembly attached to it from the liner tieback extension 10. Thus it is desired to keep debris from entering the annular space 14 between the tieback extension tubular 10 and the lift sub 12.

Figure 1:
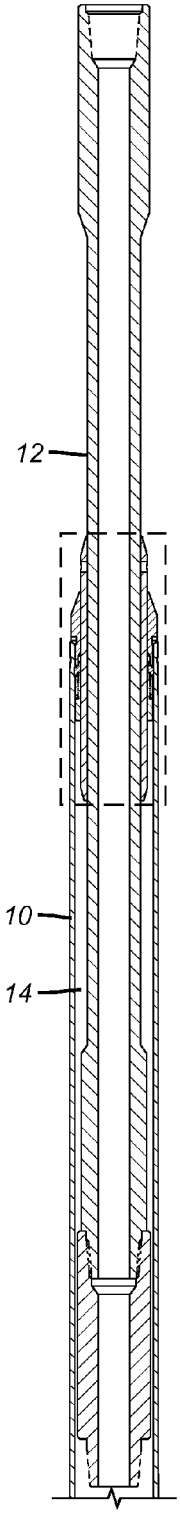
FIG. 1 shows a run in position of the debris barrier locked inside the liner tieback extension.
Figure 2:
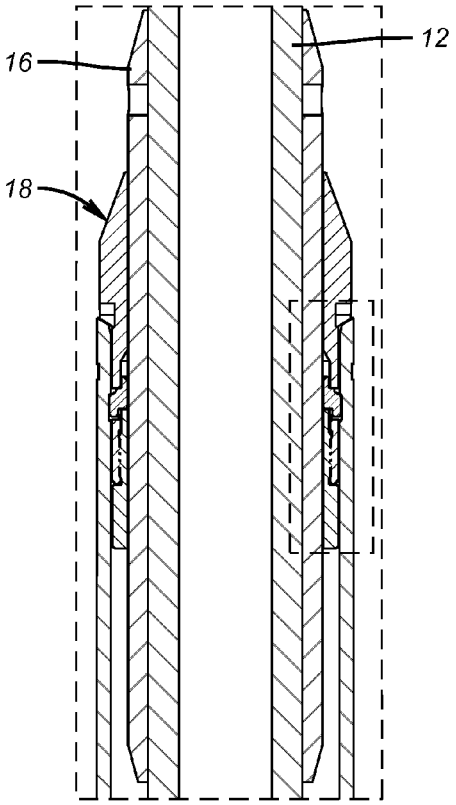
FIG. 2 is a closer view of the debris barrier in the FIG. 1 position.
Figure 3:
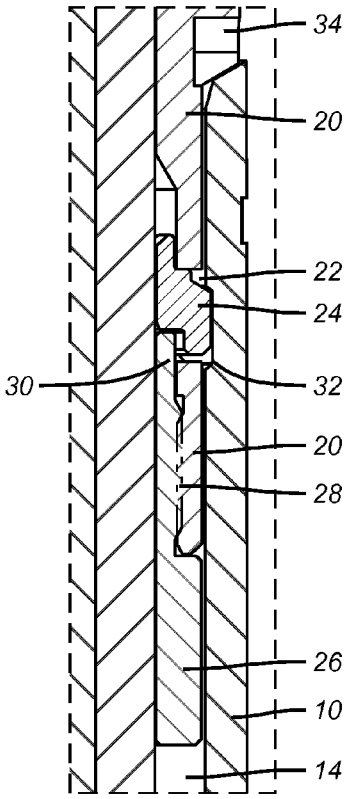
FIG. 3 is a closer view of the debris barrier shown in FIG. 2.
Figure 4:
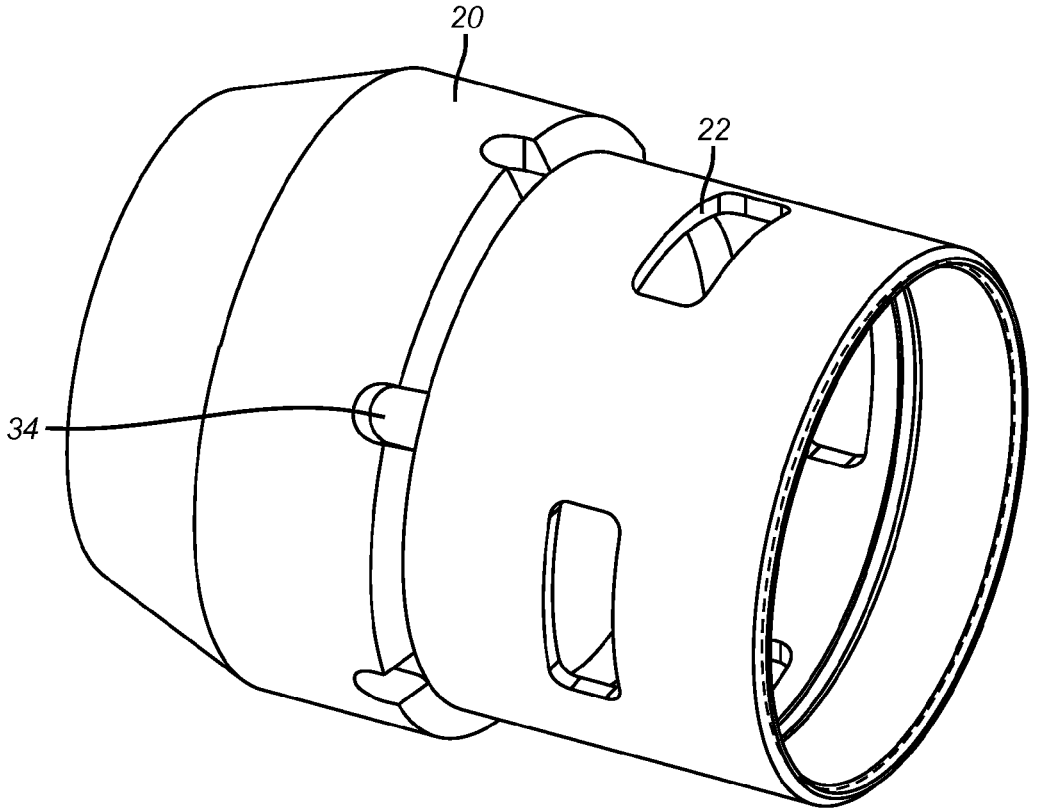
FIG. 4 is a perspective view of the body of the debris barrier of FIG. 1.

Referring to FIGS. 2 and 3 a sleeve assembly 16 preferably loosely fits over lift sub 12 while extending through the debris barrier assembly 18. Assembly 18 has a housing 20 whose details are best shown in FIG. 4. The tubular shape has openings 22 through which extend dogs 24. A retainer 26 is threaded at 28 to the housing 20. An extending segment 30 of the retainer 26 is axially aligned with each window or opening 22 to keep the dogs 24 from falling in when the sleeve assembly 16 is no longer aligned with the dogs 24. FIG. 3 illustrates the view as assembled for running in the hole. It is preferred that the sleeve 16 is in an interference fit with the dogs 24 to push the dogs 24 radially outwardly into respective grooves 32 formed in the liner tieback extension 10. Thus in the FIG. 3 view the debris barrier 18 is locked to the liner tieback extension 10 and spans the annular space 14 with some clearance against the sleeve 16. Housing 20 has exterior slots 34 that allow fluid communication from annulus 14 to outside the liner tieback extension 10 so as not to allow the liner tieback extension to collapse due to the increase of differential pressure across the liner tieback extension as the liner is advanced into the wellbore or impede the release of the inner running string by providing an alternative fluid flow path for displaced fluid. The number, shape and placement of the openings or slots 34 can be varied without departing from the scope of the invention. The circumferential extent of the dogs 24 is dependent on their configuration and the total number used for the expected loading.

Figure 5:
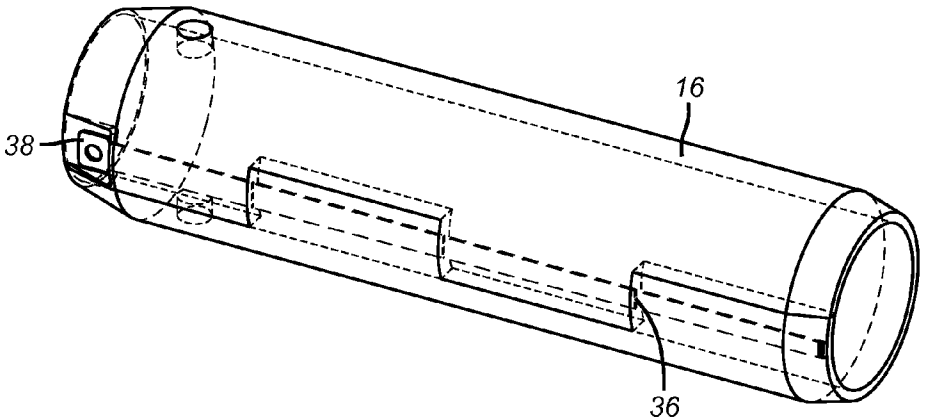
FIG. 5 is a perspective view of a one piece inner sleeve for the debris barrier of FIG. 1.
Figure 6:
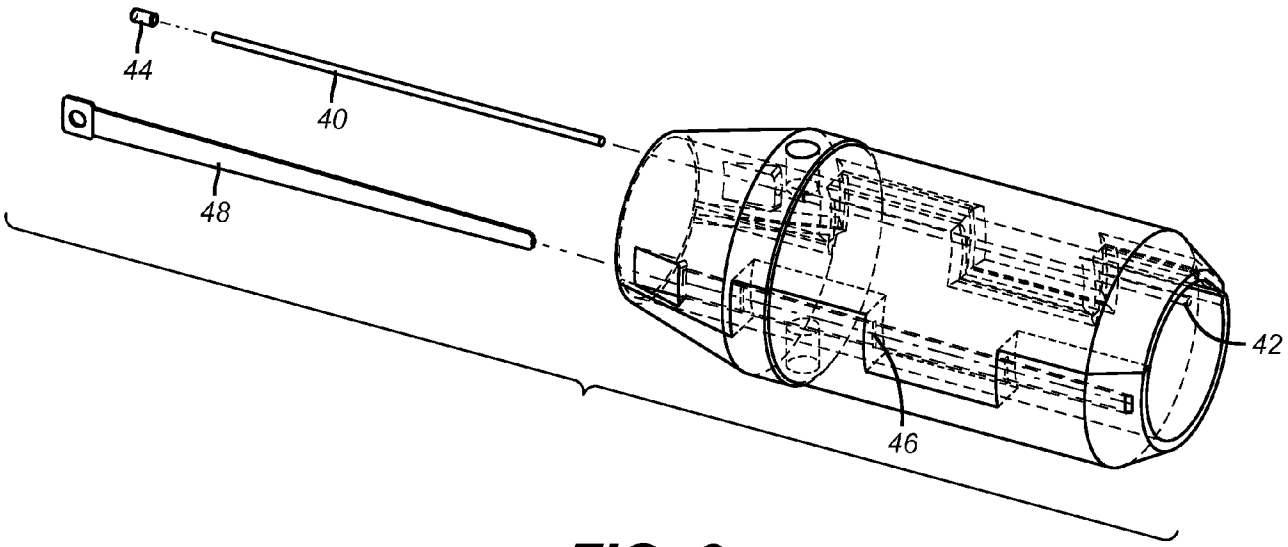
FIG. 6 is a two piece variation of the sleeve in FIG. 5.

Referring to FIGS. 5 and 6 it can be seen that the sleeve assembly 16 can be a single piece that wraps over the lift sub 12 with formed loops 36 that align so that a tapered pin 38 can be pushed through the aligned loops 36 bring them into the annular shape that defines the sleeve assembly 16. FIG. 6 is a two piece alternative for mounting the sleeve assembly 16 about the lift sub 12 by inserting a hinge pin 40 in aligned loops 42 and securing the pin 40 with a set screw 44. Located 180 degrees away are loops 46 that come into alignment and are held that way by tapered pin 48.

Figure 6A:
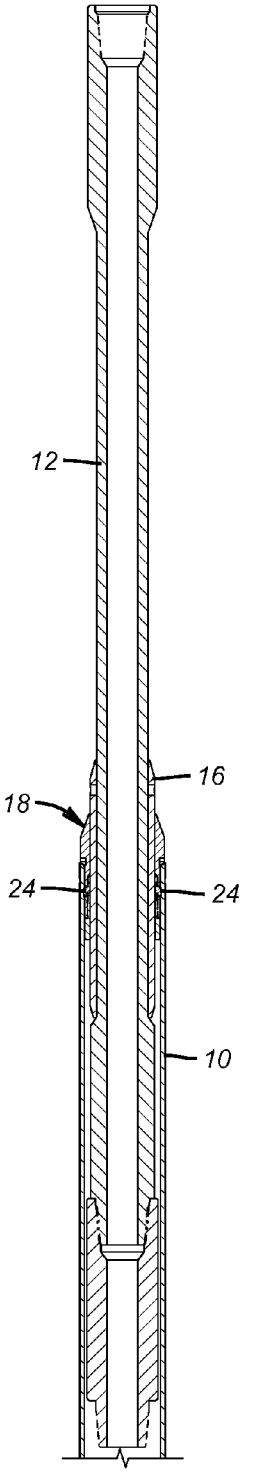
FIG. 6*a* is a section view of the debris barrier of FIG. 1 just before retrieval with the inner running string lifted and the debris barrier still locked.
Figure 7:
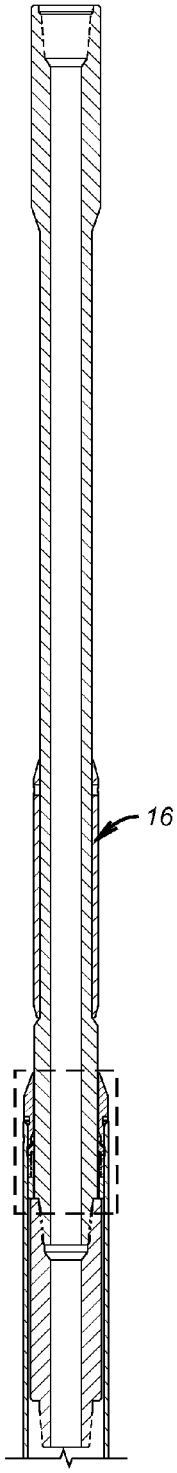
FIG. 7 is the view of FIG. 6 showing the inner sleeve lifted out of the debris barrier.
Figure 8:
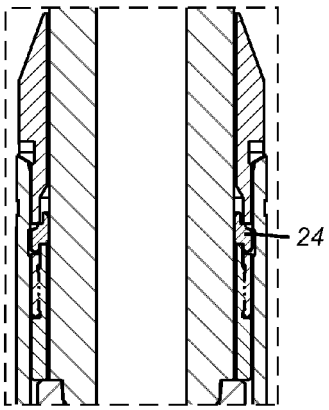
FIG. 8 is the view of FIG. 7 in greater detail showing the dogs unsupported.
Figure 9:
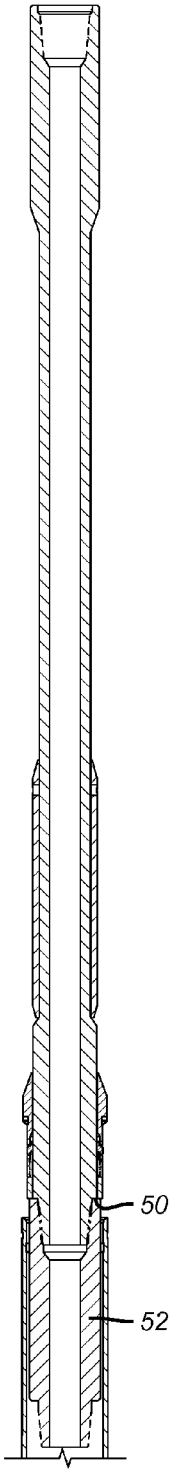
FIG. 9 is the view of FIG. 8 showing the debris barrier removed from the liner and captured by the inner running string.
Figure 10:
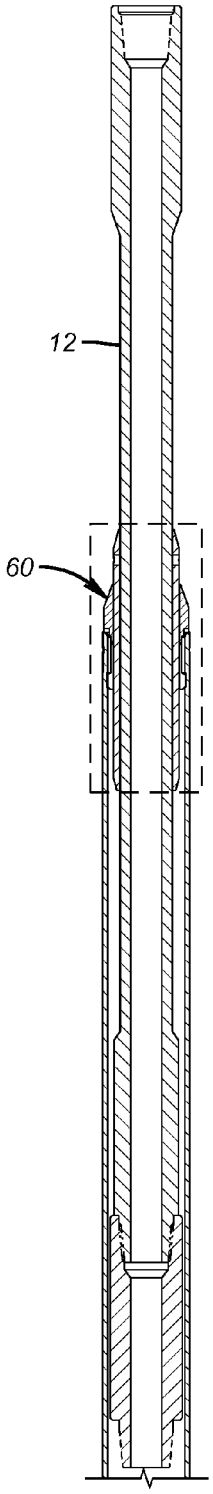
FIG. 10 is a run in position of an alternative embodiment of the debris barrier with collets.
Figure 11:
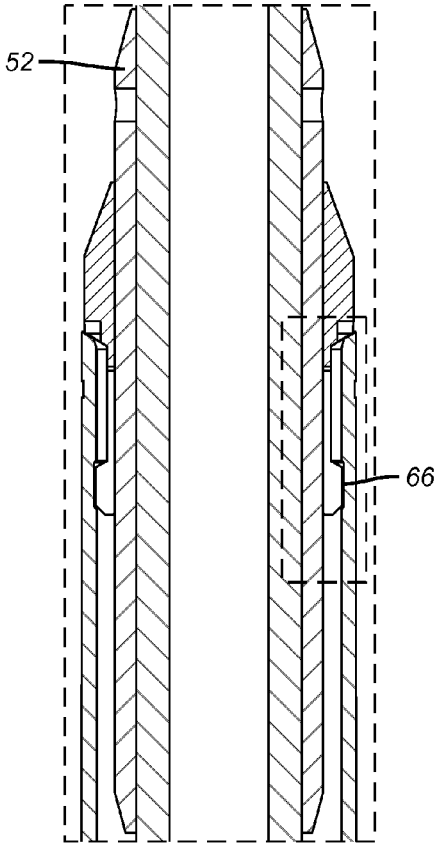
FIG. 11 is an enlarged view of FIG. 10.
Figure 12:
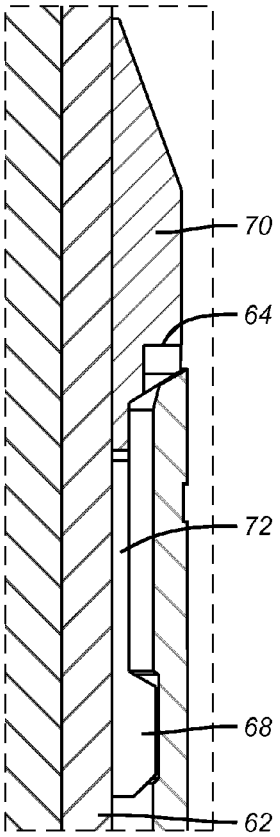
FIG. 12 is an enlarged view of FIG. 11.
Figure 13:
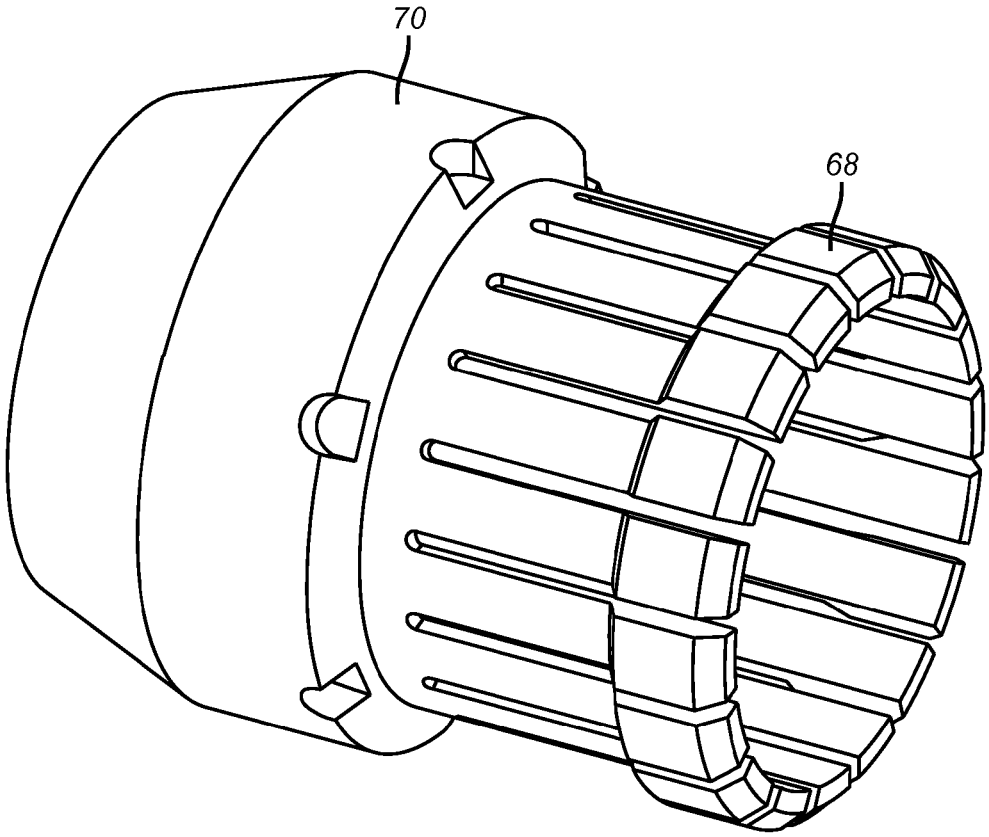
FIG. 13 is a perspective view of the body of the debris barrier of FIG. 10.

FIG. 6*a* illustrates the debris barrier still locked despite the lift sub 12 having been lifted to determine release from the liner and tieback extension. Note that sleeve assembly 16 is still behind and supporting dogs 24 extended into groove 32 in the tieback extension tubular 10. Further lifting takes sleeve assembly 16 out from under dogs 24 and lets them retract to the point where they are stopped by extending segment 30. The debris barrier 18 is now released as shown in FIGS. 7 and 8. Further lifting catches the debris barrier 18 on shoulder 50 of the lower lift sub 52.

FIGS. 10-17 illustrate a collet style debris barrier 60 that in other ways works the same as the previous embodiment that used dogs 24. A sleeve assembly 62 is the same as 16. Slots 64 permit fluid entry into the liner tieback extension during running in and are there for the same reason as slots 34 in the previous embodiment. Optionally, in either case these slots can be screened to keep out debris. Groove 66 receives collet heads 68 that extend on fingers 72 from a base ring 70. Sleeve assembly 62 pushes heads 68 outwardly into grove 66 in the assembled position for run in shown in FIGS. 10-12. As before it is preferred that the inside diameter of the sleeve assembly 62 is somewhat larger that the outside diameter of lift sub 12 to allow lifting sub 12 with minimal resistance from sleeve assembly 62. With collet heads 68 supported in groove 66 the debris barrier 60 is locked to tubular tieback extension 10 while the lift sub 12 has the ability to come uphole.

Figure 14:
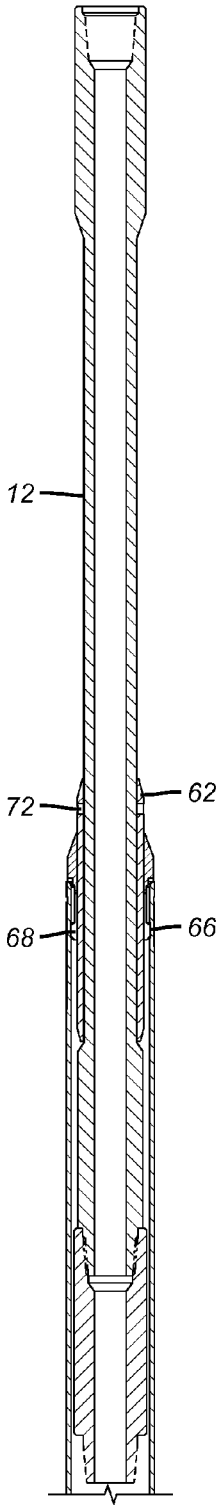
FIG. 14 shows the debris barrier of FIG. 10 with the mandrel lifted leaving the debris barrier still locked.
Figure 15:
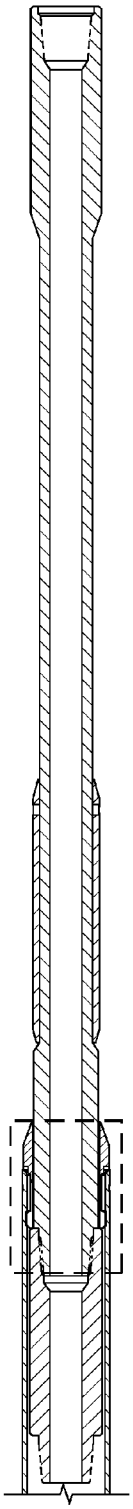
FIG. 15 is the view of FIG. 14 with the debris barrier unlocked.
Figure 16:
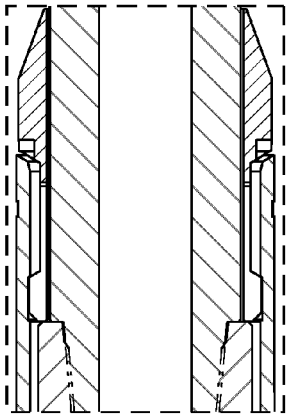
FIG. 16 is a close up view of the debris barrier of FIG. 15.
Figure 17:
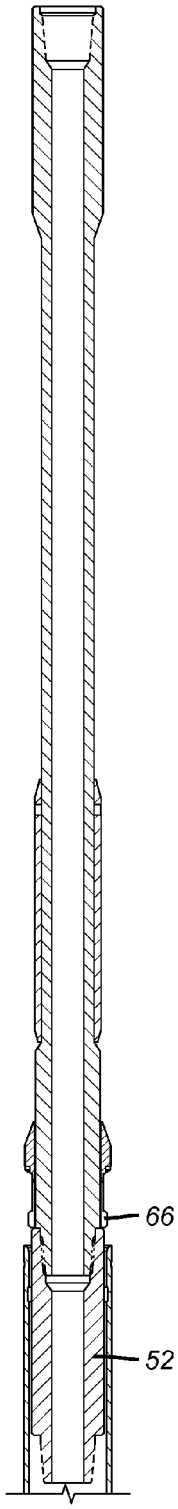
FIG. 17 shows the debris barrier of FIG. 16 removed from the liner tieback extension and captured for removal to the surface.
Figure 18:
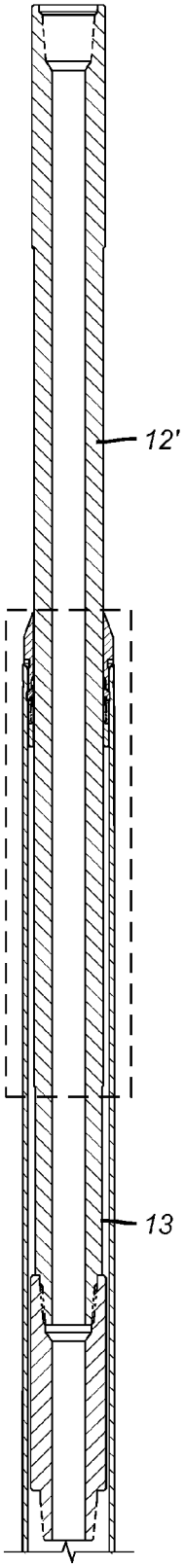
FIG. 18 is an alternative embodiment to FIG. 1 using the mandrel to retain the locked position and a recessed surface to release the debris barrier all instead of the sleeve.
Figure 19:
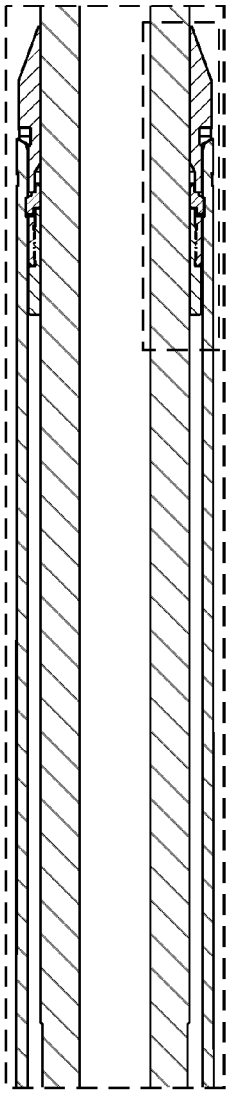
FIG. 19 is an enlarged view of FIG. 18 in the debris barrier locked position.
Figure 20:
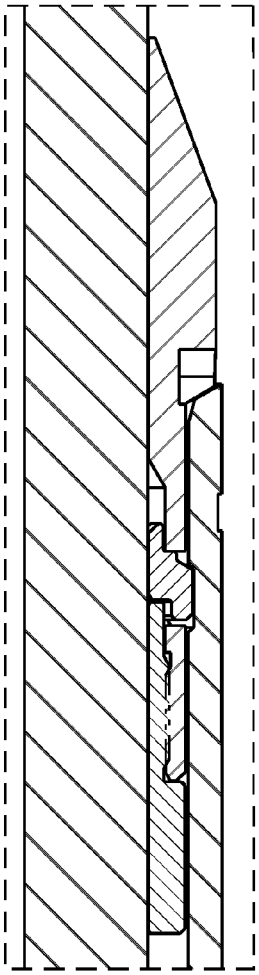
FIG. 20 is an enlarged view of FIG. 19 in the debris barrier locked position.
Figure 21:
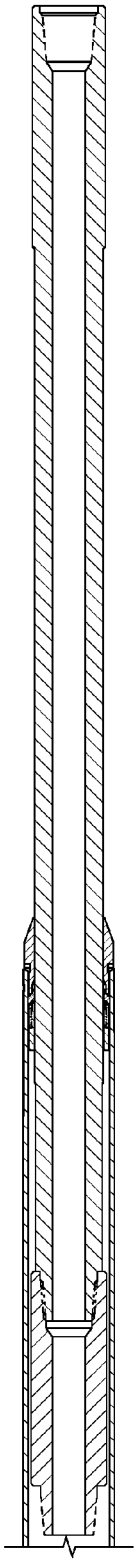
FIG. 21 is the view of FIG. 18 in the debris barrier released position.
Figure 22:
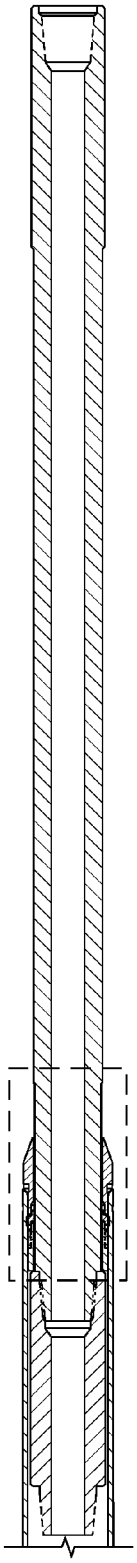
FIG. 22 is an enlarged view of FIG. 21 in the debris barrier released position.

As shown in FIG. 14 the lift sub 12 is lifted to determine release from the liner while the debris barrier 60 is still locked to tubular tieback extension 10 because sleeve assembly 62 continues to hold the collet heads 68 trapped to groove 66. It should be noted that blind bores 72 on sleeve assembly 62 are used for insertion of tools during the assembly process. To release the debris barrier 60 from the tubular tieback extension 10 further lifting of the lift sub 12 brings the sleeve assembly 62 axially away from the collet heads 68 allowing those heads to flex inwardly and out of groove 66 for a full release. Eventually, the lower lift sub 52 catches the collet heads 68 as shown in FIG. 17 and the debris barrier 60 comes out with the inner running string assembly.

Figure 23:
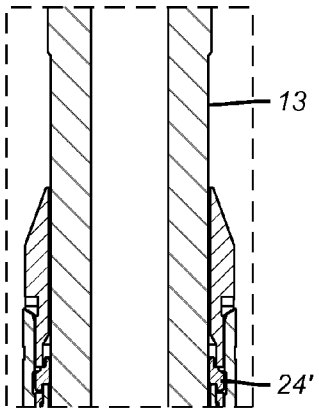
FIG. 23 is an enlarged view of FIG. 22 in the debris barrier released position.
Figure 24:
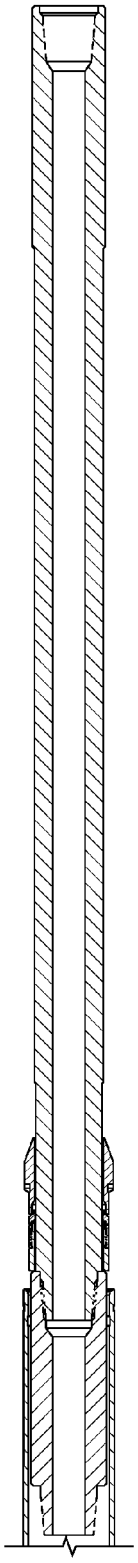
FIG. 24 is the view of FIG. 21 with the debris barrier removed from the surrounding tubular.

An alternative embodiment that eliminated the sleeve 16 is shown in FIGS. 18-24. The operation is the same as previously described with sleeve 16 with the exception that the sleeve 16 is eliminated and the dimension of the lift sub 12' is increased to compensate for the removal of the sleeve and an elongated undercut 13 is provided to unlock the debris barrier assembly when presented opposite dogs 14' as shown in FIG. 23.

Those skilled in the art will appreciate that a releasable debris barrier that is selectively mechanically locked is disclosed to assure that it stays put and excludes debris throughout the time that it is needed for that function and continues to function as the string is lifted to ensure release from the liner before cementing. After the operations conclude, further lifting on the lift sub 12 gets the supporting sleeve assembly sufficiently axially displaced so that the lock for the debris barrier can be defeated to allow a shoulder on the inner running string to capture the debris barrier and bring it to the surface with the inner running string.

The above description is illustrative of the preferred embodiment and many modifications may be made by those skilled in the art without departing from the invention whose scope is to be determined from the literal and equivalent scope of the claims below:

I claim:

1. A debris barrier assembly for an annular gap between relatively movable tubular members comprising:

an inner tubular member surrounded by an outer tubular member to define an annular gap therebetween;

said inner tubular member movable uphole and downhole with respect to said outer tubular member;

an annularly shaped debris barrier disposed in said gap adjacent an upper end of said outer tubular member and above a seal in said annular gap to protect said seal from debris, said debris barrier selectively mechanically locked with a lock having a longitudinal height extending from an upper end to a lower end thereof, said lock extending radially at least in part to a locking groove in said outer tubular member and remaining locked during a predetermined uphole and downhole relative movement of said inner tubular member greater than said longitudinal height whereupon lifting said inner tubular member relative to said outer tubular member beyond said predetermined amount releases said debris barrier from said outer tubular member.

2. The assembly of claim 1, wherein:

relative movement beyond said predetermined amount releases said lock whose release allows said removal of said debris barrier from said outer tubular member.

3. The assembly of claim 1, wherein:

said debris barrier comprises a housing and at least one dog selectively radially extendable through said housing and into at least one groove in said outer tubular.

4. The assembly of claim 3, wherein:

said dog retained in an extended position by contact with a sleeve assembly mounted over said inner tubular.

5. The assembly of claim 4, wherein:

said sleeve assembly surrounds said inner tubular with a clearance.

6. The assembly of claim 5, wherein:

said sleeve assembly comprises a split that allows placement of the sleeve assembly over said inner tubular and closing said split.

7. The assembly of claim 6, wherein:

said split comprises loops on opposed ends that are axially offset and that come into alignment for insertion of a pin therethrough.

8. The assembly of claim 7, wherein:

said pin is tapered.

9. The assembly of claim 6, wherein:

said sleeve assembly further comprises a hinge.

10. The assembly of claim 9, wherein:

said split is located about 180 degrees from said hinge.

11. The assembly of claim 4, wherein:

said inner tubular moves a predetermined axial distance without axially translating said sleeve assembly.

12. The assembly of claim 11, wherein:

said inner tubular and said sleeve assembly move in tandem axially after a predetermined axial movement of said inner tubular relative to said outer tubular.

13. The assembly of claim 12, wherein:

said dog is undermined for radial movement out of said groove as a result of axial movement of said sleeve assembly;

said dog is retained in said radial movement out of said groove by a travel stop.

14. A debris barrier assembly for an annular gap between relatively movable tubular members comprising:

an inner tubular member surrounded by an outer tubular member to define an annular gap therebetween;

said inner tubular member movable uphole and downhole with respect to said outer tubular member;

an annularly shaped debris barrier disposed in said gap and selectively mechanically locked with a lock having a longitudinal height extending from an upper end to a lower end thereof, said lock extending radially at least in part to a locking groove in said outer tubular member and remaining locked during a predetermined uphole and downhole relative movement of said inner tubular member greater than said longitudinal height whereupon lifting said inner tubular member relative to said outer tubular member beyond said predetermined amount releases said debris barrier from said outer tubular member;

said debris barrier comprises a ring with at least one flexible extending member having a head that is selectively held to at least one groove in said outer tubular.

15. The assembly of claim 14, wherein:

said head retained in an extended position by contact with a sleeve assembly mounted over said inner tubular.

16. The assembly of claim 15, wherein:

said sleeve assembly surrounds said inner tubular with a clearance.

17. The assembly of claim 16, wherein:

said inner tubular moves a predetermined axial distance without axially translating said sleeve assembly.

18. The assembly of claim 17, wherein:

said inner tubular and said sleeve assembly move in tandem axially after said inner tubular moves said predetermined axial distance.

19. The assembly of claim 18, wherein:

said head is undermined for radial movement out of said groove as a result of axial movement of said sleeve assembly;

said flexible extending member moves said head out of said groove upon axial translation of said sleeve assembly out of contact with said head.

20. The assembly of claim 14, wherein:

said inner tubular has a larger dimension that retains said head to said groove in said outer tubular;

said inner tubular has a recess that when aligned with said head due to axial movement allows said head to release from said groove in said outer tubular.

21. A debris barrier assembly for an annular gap between relatively movable tubular members comprising:

an inner tubular member surrounded by an outer tubular member to define an annular gap therebetween;

said inner tubular member movable uphole and downhole with respect to said outer tubular member;

an annularly shaped debris barrier disposed in said gap and selectively mechanically locked with a lock having a longitudinal height extending from an upper end to a lower end thereof, said lock extending radially at least in part to a locking groove in said outer tubular member and remaining locked during a predetermined uphole and downhole relative movement of said inner tubular member greater than said longitudinal height whereupon lifting said inner tubular member relative to said outer tubular member beyond said predetermined amount releases said debris barrier from said outer tubular member;

said debris barrier comprises at least one peripheral slot adjacent said outer tubular to allow fluid flow induced by relative movement between said tubulars.

22. The assembly of claim 21, wherein:

said slot comprises a screen to prevent debris entrance into the annular gap through said slot.

23. A debris barrier assembly for an annular gap between relatively movable tubular members comprising:

an inner tubular member surrounded by an outer tubular member to define an annular gap therebetween;

said inner tubular member movable uphole and downhole with respect to said outer tubular member;

an annularly shaped debris barrier disposed in said gap and selectively mechanically locked with a lock having a longitudinal height extending from an upper end to a lower end thereof, said lock extending radially at least in part to a locking groove in said outer tubular member and remaining locked during a predetermined uphole and downhole relative movement of said inner tubular member greater than said longitudinal height whereupon lifting said inner tubular member relative to said outer tubular member beyond said predetermined amount releases said debris barrier from said outer tubular member;

said debris barrier comprises a housing and at least one dog selectively radially extendable through said housing and into at least one groove in said outer tubular;

said inner tubular has a larger dimension that retains said dog to said groove in said outer tubular;

said inner tubular has a smaller radial dimension that when aligned with said dog due to axial movement allows said dog to release from said groove in said outer tubular.

* * * * *